US007684582B2

(12) United States Patent
Gladwin et al.

(10) Patent No.: US 7,684,582 B2
(45) Date of Patent: Mar. 23, 2010

(54) ELECTRODYNAMIC ACOUSTIC TRANSDUCER

(75) Inventors: Timothy A. Gladwin, Pakenham (CA); Robert G. Johnston, Arnprior (CA)

(73) Assignee: DEI Headquarters, Inc., Vista, CA (US)

( * ) Notice: Subject to any disclaimer, the term of this patent is extended or adjusted under 35 U.S.C. 154(b) by 1171 days.

(21) Appl. No.: 11/202,436

(22) Filed: Aug. 11, 2005

(65) Prior Publication Data

US 2007/0036382 A1 Feb. 15, 2007

(51) Int. Cl.
*H04R 25/00* (2006.01)

(52) U.S. Cl. ..... 381/337; 381/339; 381/343

(58) Field of Classification Search ..... 381/337, 381/339–343, 403, 404, 405; 181/152, 177, 181/185, 191, 192, 195
See application file for complete search history.

(56) References Cited

U.S. PATENT DOCUMENTS 2,269,284 A * 1/1942 Olson ..... 381/342
4,239,943 A 12/1980 Czerwinski
4,492,826 A 1/1985 Chiu
6,320,970 B1 11/2001 Czerwinski et al.
6,320,972 B1 11/2001 Goller
6,557,664 B1 * 5/2003 Andrews et al. ..... 181/152
6,732,832 B2 5/2004 Chan

FOREIGN PATENT DOCUMENTS

GB 2270606 3/1994
GB 2388488 11/2003
JP 56-111399 9/1981
JP 58-142694 8/1983
JP 59-112798 6/1984

* cited by examiner

*Primary Examiner*—Huyen D Le

(57) ABSTRACT

An acoustic transducer includes a frame, voice coil movable along a pole, magnetic structure generating magnetic flux in a gap where the voice coil moves, diaphragm attached to the coil, waveguide extension in front of the pole, inner flexible roll seal connecting the waveguide extension to neck area of the diaphragm, and outer seal connecting outer periphery of the diaphragm to the frame. The inner flexible roll seal seals the gap between the voice coil and the pole, isolating the air in front of the diaphragm from the air behind the diaphragm. The inner seal provides damping of unwanted resonances of the diaphragm. Together, the inner seal and the outer seal do not substantially decrease the piston area of the transducer, and do not substantially affect the transducer's movement. In combination, the inner seal and the waveguide extension tend to increase efficiency and decrease audio distortions of the transducer.

34 Claims, 5 Drawing Sheets

ELECTRODYNAMIC ACOUSTIC TRANSDUCER

FIELD OF THE INVENTION

This invention relates generally to the field of sound generation and reproduction. More particularly, the invention relates to speakers, woofers, tweeters, and other acoustic transducers of electrodynamic type.

BACKGROUND

An electrodynamic acoustic transducer is a device that transforms electrical signals into sound waves, for example, into audible sounds. Its design is an important determinant of overall performance of audio reproduction and generation systems. In choosing a particular acoustic transducer design, engineers generally balance many competing considerations. Such considerations may include frequency range of the transducer, in-band amplitude and phase distortions, efficiency, and the Q factor. Electrodynamic transducers are generally categorized as (1) direct radiating transducers ("direct radiators") in which the vibrating surface radiates sound waves directly into open air, or (2) horn-loaded transducers that radiate through a horn, i.e., transducers in which a horn is interposed between the vibrating surface and the open air. Horn-loaded transducers are also known as horn-driven transducers and compression drivers.

A typical dynamic transducer/speaker includes an electrodynamic motor that moves a diaphragm or cone. The motor of the transducer has a voice coil with wire windings on a voice coil former. The voice coil moves along a cylindrical pole piece in an air gap where magnetic field (flux) is generated by a permanent magnet. The former of the voice coil is mechanically coupled to the diaphragm. When an electrical current drives the voice coil, the coil moves under influence of the Lorentz electromotive force exerted by the magnetic field of the permanent magnet on the charged particles flowing through the voice coil's windings. The diaphragm moves together with the coil, creating variable acoustic pressure that generates the sound represented by the electrical current.

This design has performance deficiencies at both low and high frequencies. At low frequencies, for example, air tends to leak through the gap between the voice coil and the pole piece, causing noise and loss of acoustic output power. This is particularly problematic in direct radiators, because of the relatively low sound pressure generated by the diaphragm. At high frequencies, the cavity formed by the diaphragm, pole, and voice coil tends to resonate, causing irregularities in the frequency response, i.e., exacerbating sound distortions. Moreover, an underdamped inner surface of the diaphragm may cause unwanted reflections, which further add to the high frequency distortions.

One way to alleviate some of these disadvantages is illustrated in FIG. 1, which shows an electrodynamic acoustic transducer 100. The transducer 100 includes a dustcap 105 that effectively seals the air leaks through a gap 110 between a voice coil 115 and pole piece 120. By sealing the gap 110, the dustcap 105 reduces the low frequency noise and improves acoustic power output of the transducer 100. The dustcap 105 also provides a resistive termination of the inner diaphragm 125, dampening unwanted reflections. This, however, is a partial solution: the dustcap 105 does not fill the cavity formed by the voice coil 115, pole piece 120, and diaphragm 125. Therefore, the dustcap 105 does not eliminate the cavity resonances that tend to distort high frequency response of the transducer 100.

Another way to alleviate some of the disadvantages of the typical transducer design is by using a waveguide extension structure. This is illustrated in FIG. 2, which shows an electrodynamic acoustic transducer 200. The transducer 200 is similar to the transducer 100 of FIG. 1, but without a dustcap. Instead, a waveguide extension structure 250 is disposed within the cavity formed by a voice coil 215, pole piece 220, and diaphragm 225. The waveguide extension structure 250 fills this cavity and reduces the high frequency distortions that result from the cavity resonances. Unfortunately, the waveguide extension structure 250 does not prevent air leakage through a gap 210 between the voice coil 215 and the pole piece 220, and does not provide termination damping.

Thus, known electrodynamic acoustic transducers suffer from one or more of the deficiencies described above. It would be desirable to provide an approach for improving transducer response at both low and high frequencies, reducing noise, and reducing or preventing loss of acoustic power output due to air leakage between a transducer's voice coil and pole piece.

SUMMARY

A need thus exists for electrodynamic acoustic transducers that reduce or eliminate air leakage through the gap between transducer voice coil and pole piece. Another need exists for electrodynamic acoustic transducers that reduce noise. Yet another need exists for electrodynamic acoustic transducers that reduce or eliminate high frequency resonances in the cavity formed by transducer voice coil, pole piece, and diaphragm. Still another need exists for electrodynamic acoustic transducers that provide resistive (lossy) termination damping of reflections from transducer diaphragm.

Embodiments of the present invention are directed to acoustic transducers that satisfy one or more of these needs. In some aspects, the invention herein disclosed is an acoustic transducer that includes a frame, a cylindrical pole piece, a voice coil, a magnetic structure (e.g., a permanent magnet and a front plate), a diaphragm, a waveguide extension structure, and an inner flexible roll seal (also known simply as an "inner seal"). The voice coil has wire windings for receiving the electrical current driving the transducer, and is disposed on a first end of the pole piece within an air gap in which the magnetic structure creates a focused (concentrated) magnetic flux. When the electrical current flows through the wire windings, the magnetic flux in the air gap interacts with the voice coil to cause the coil to move along the pole piece. The diaphragm has an inner periphery that defines a central opening, and an outer periphery. The neck area of the diaphragm is near the inner periphery. At the neck area, the diaphragm is attached to the voice coil, so that the diaphragm moves together with the voice coil. The waveguide extension structure is disposed on the first end of the pole piece to fill the cavity in front of the pole piece. The inner flexible roll seal is coupled to the diaphragm and to the waveguide extension structure, sealing a gap between the voice coil and the first end of the pole piece, thereby isolating the air in front of the diaphragm from the air behind the diaphragm.

In selected aspects, the inner flexible roll seal is made from a non-porous material, for example, synthetic rubber.

In selected aspects, the inner flexible roll seal includes an elastic damping material that dampens sound waves within frequency range of the acoustic transducer to a substantially greater degree than the degree of damping of the sound waves by the diaphragm. For example, the elastic damping material may be a plasticizer.

In selected aspects, the inner flexible roll seal is substantially arch-like in cross-section. For example, the cross-section may be semi-circular.

In selected aspects, the decrease in effective piston area of the transducer caused by the inner flexible roll seal and the waveguide extension structure is less than about ten percent as compared to a transducer with identical components but without the inner flexible roll seal and without the waveguide extension structure.

In selected aspects, the decrease in efficiency of the transducer caused by the inner flexible roll seal and the waveguide extension structure is less than about ten percent as compared to a transducer with identical components but without the inner flexible roll seal and without the waveguide extension structure.

In selected aspects, the increase in moving mass of the transducer caused by the inner flexible roll seal and the waveguide extension structure is less than about ten percent as compared to a transducer with identical components but without the inner flexible roll seal and without the waveguide extension structure.

In selected aspects, the inner flexible roll seal is a ring of elastometric non-porous material.

In selected aspects, the transducer also includes an outer roll seal attaching the outer periphery of the diaphragm to the frame.

In selected aspects, the acoustic transducer also includes a spider attached to the frame and to the voice coil. The spider aligns and centers the voice coil on the pole piece.

In selected aspects, the outer roll seal is made from substantially the same material as the inner flexible roll seal.

In selected aspects, the outer roll seal has substantially the same working geometry and excursion capability as the inner flexible roll seal. For example, the two roll seals may have the same or similar cross-section, such as roll radius and excursion capability. In this way, the addition of the inner roll seal does not limit the excursion beyond the limits imposed by the outer roll seal.

In selected aspects, the waveguide extension structure extends substantially to a plane defined by the outer periphery of the diaphragm when the voice coil is at rest.

In selected aspects, the waveguide extension structure extends not farther (or not substantially farther) than a plane defined by the outer periphery of the diaphragm when the voice coil is at maximum forward excursion, i.e., when the voice coil at a point farthest from the back plate or base of the transducer.

In selected aspects, the waveguide extension structure occupies more than one half of the volume of a cavity formed by projecting the first end of the pole piece to a plane defined by the outer periphery of the diaphragm.

These and other features and aspects of the invention will be better understood with reference to the following description, drawings, and appended claims.

DETAILED DESCRIPTION

Figure 1:
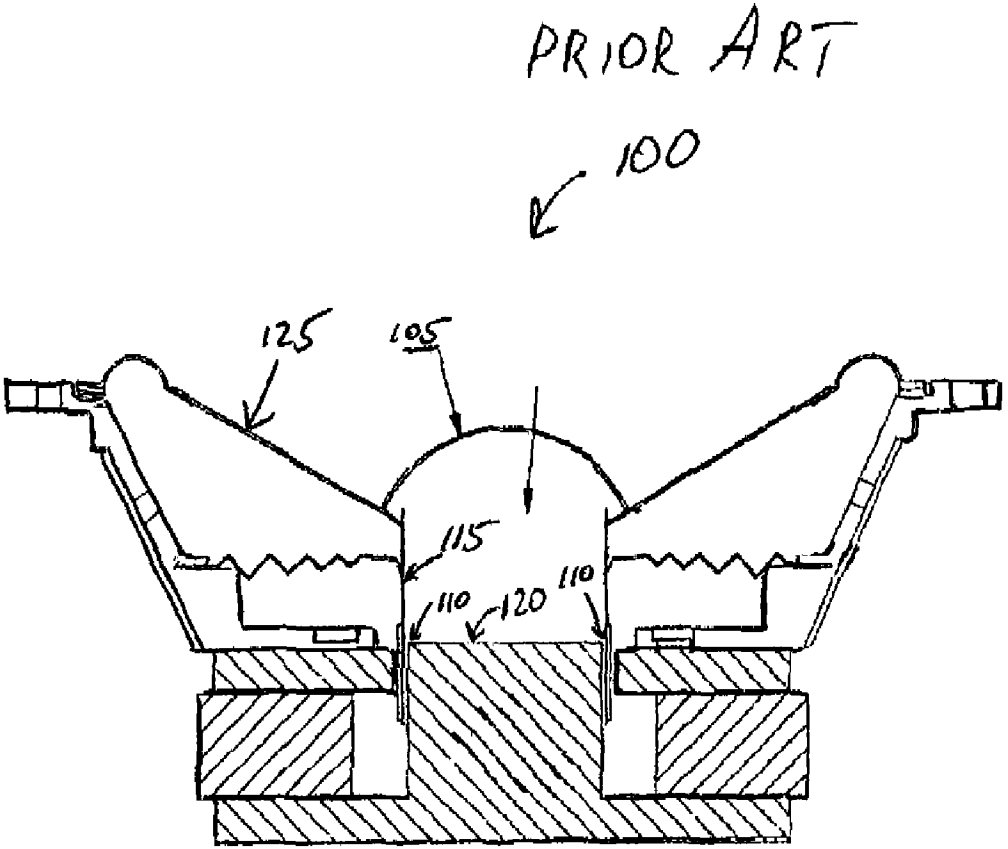
FIG. 1 illustrates a prior art electrodynamic acoustic transducer with a dustcap for reducing air leakage through the gap formed between the transducer's voice coil and pole piece.
Figure 2:
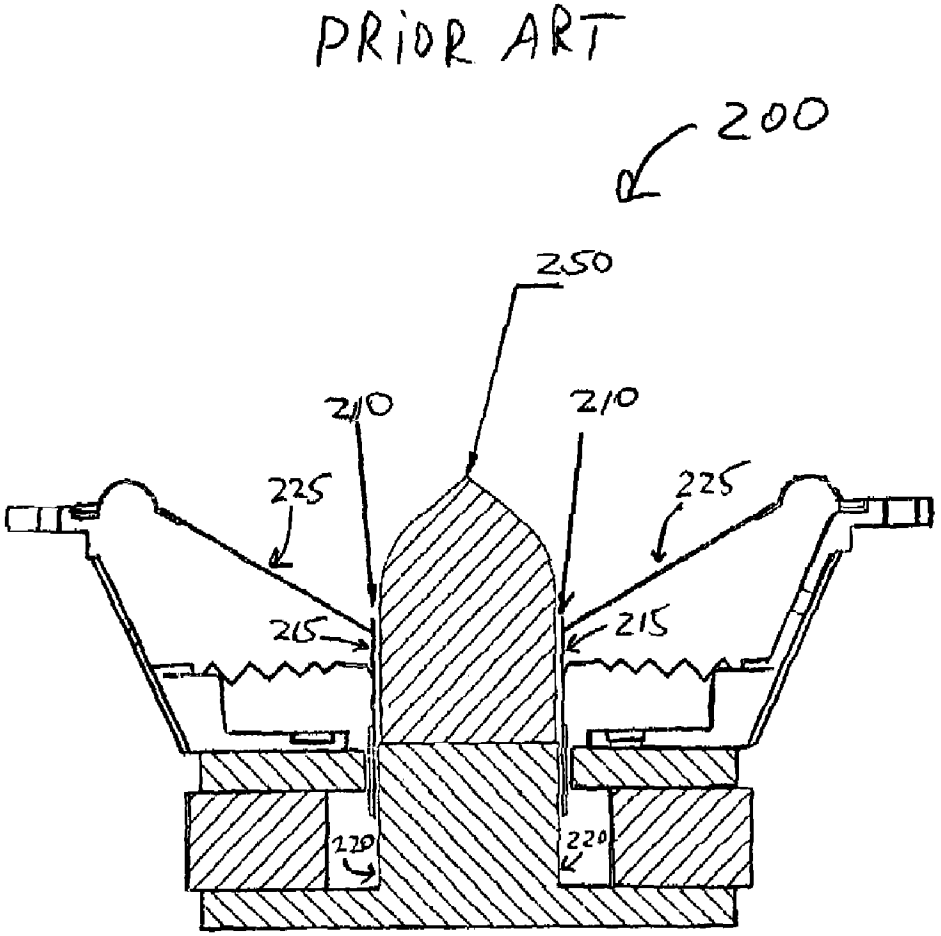
FIG. 2 illustrates a prior art electrodynamic acoustic transducer with a waveguide disposed within the cavity formed by the transducer's voice coil, pole piece, and diaphragm.

In this document, including the specification and appended claims, the words "embodiment" and "variant," as well as similar expressions, refer to particular apparatus, process, or article of manufacture, and not necessarily to the same apparatus, process, or article of manufacture. Thus, "an embodiment," "one embodiment," "some embodiments" or a similar expression used in one place or context can refer to a particular apparatus, process, article of manufacture, or a plurality thereof; the same or a similar expression in a different place can refer to the same or a different apparatus, process, article of manufacture, or a plurality thereof. The expressions "alternative embodiment," "alternatively," and similar phrases are used to indicate one of a number of different possible embodiments. The number of possible embodiments is not necessarily limited to two or any other quantity.

The words "couple," "connect," "attach," and similar expressions with their inflectional morphemes do not necessarily import an immediate or direct connection, but include connections through mediate elements within their meaning.

The words "cone" and "diaphragm" are used interchangeably to indicate the portion of an electrodynamic acoustic transducer that is moved (vibrated) by the transducer's voice coil to generate sound waves.

The expressions "outer roll seal," "outer seal," and "outer flexible roll seal" are used interchangeably to indicate an "edge" or "surround" of an electrodynamic acoustic transducer that connects the outer periphery of the transducer's diaphragm to the frame of the transducer, in order to allow limited movement of the outer periphery of the diaphragm relative to the frame.

"Excursion" refers to movement of components under influence of the electrical drive.

Other definitions may be found elsewhere in this document. The scope and spirit of the invention should not be construed as strictly limited to these definitions, or to the specific examples mentioned herein.

Reference will now be made in detail to one or more embodiments of the invention that are illustrated in the accompanying drawings. Same or similar reference numerals may be used in the drawings and the description to refer to the same apparatus elements and method steps. The drawings are in simplified form, not to scale, and omit apparatus elements and method steps that can be added to the described systems and methods, while including certain optional elements and steps. For purposes of convenience and clarity only, directional terms such as top, bottom, left, right, up, down, over, above, below, beneath, upper, lower, rear, and front may be used with respect to the accompanying drawings. These and similar directional terms should not be construed to limit the scope of the invention.

Figure 3:
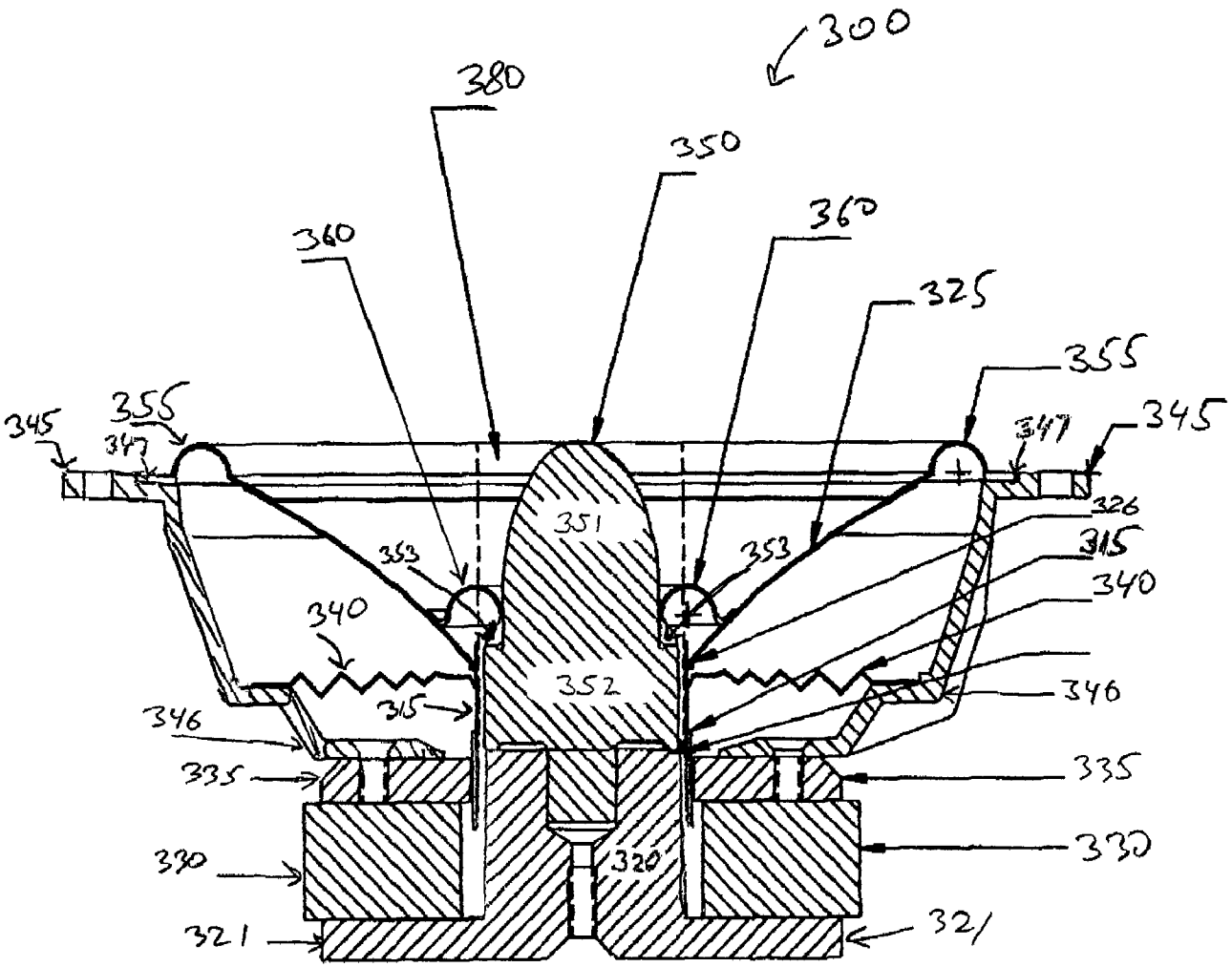
FIG. 3 illustrates a cross-section of an electrodynamic acoustic transducer with an inner flexible roll seal, in accordance with an embodiment of the present invention.

FIG. 3 shows a cross-section of an electrodynamic acoustic transducer 300 in accordance with an embodiment of the present invention. The transducer 300 includes a diaphragm 325 attached at the periphery of its center opening to a voice coil 315, so that movement of the voice coil 315 translates into movement of the diaphragm 325. The voice coil 315 is disposed on and is capable of moving along a cylindrical pole piece 320. A small gap exists between the voice coil 315 and the pole piece 320.

In the illustrated embodiment, the pole piece 320 is integrated with a back plate (or base) 321.

Permanent magnet 330 provides the static magnetic field in which the voice coil 315 moves. The magnet 330 is a substantially annular device with a central opening of sufficient diameter to accommodate the pole piece 320.

A front plate 335 is disposed on the magnet 330, so that the magnet 330 is located between the back plate 321 and the front plate 335. The front plate 335 is also substantially annular in shape with a central opening of sufficient diameter to accommodate the pole piece 320. In the illustrated embodiment, the central opening of the front plate 335 is slightly smaller than the central opening of the magnet 330, so that the gap between the front plate 335 and the pole piece 320 is smaller than the gap between the magnet 330 and the pole piece 320. The front plate 335 may be made from a magnetic material, i.e., material with high magnetic permeability, such as iron, certain other metals, and alloys of iron and/or other metals. This list is not exclusive. The pole piece 320 may also be made from magnetic material, for example, the same material as the front plate 335. Thus, the flux of the static magnetic field emanated by the magnet 330 is focused (concentrated) in the gap between the front plate 335 and the pole piece 320.

Figure 4A:
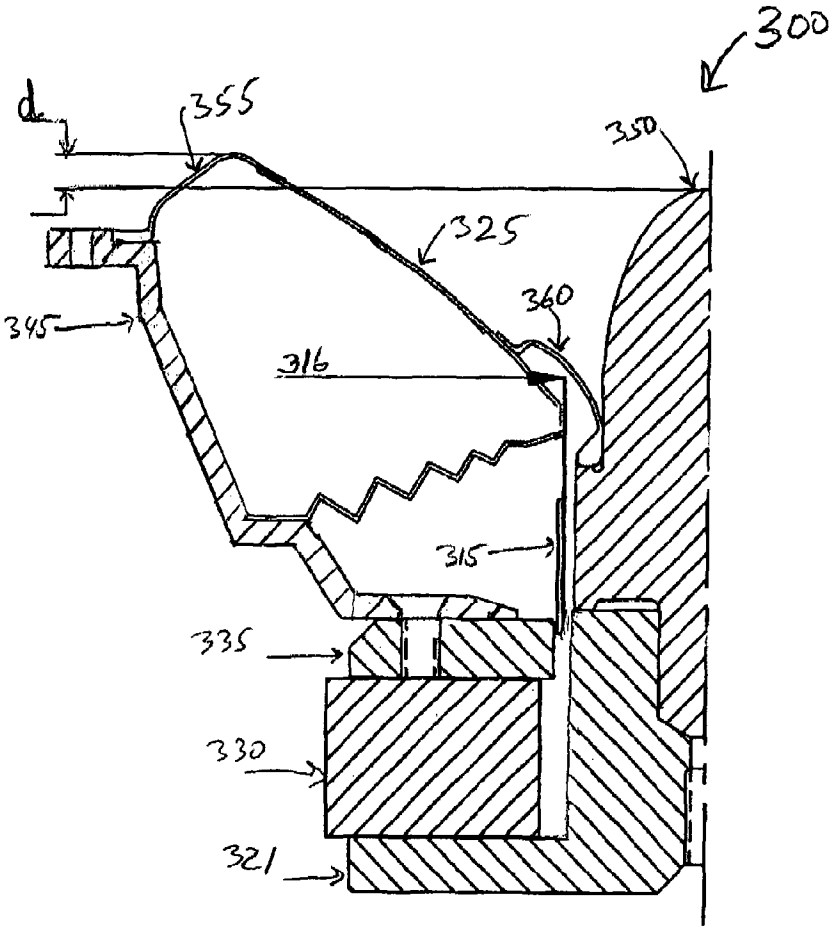
FIGS. 4A and 4B illustrate a portion of the cross-section of the transducer of FIG. 3 in maximum positive and negative peak extension states.
Figure 4B:
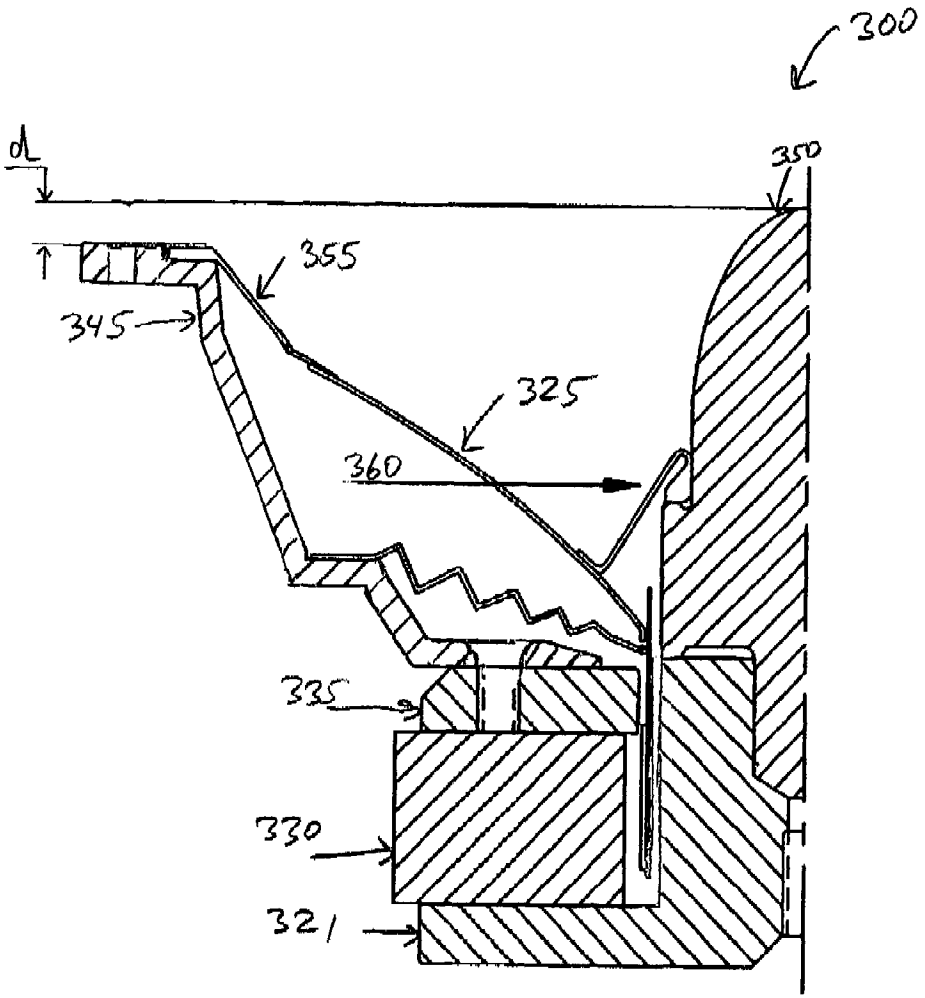

The voice coil 315, and particularly the portion of the voice coil 315 with the wire windings, can move along the pole piece 320 in the gap between the front plate 335 and the pole piece 320. The voice coil 315 moves up and down (as the directions appear in FIG. 3) under influence of Lorentz electromotive forces created by the interaction of the static magnetic field within the gap and the variable current flowing through the windings of the voice coil 315. The movement of the voice coil 315 is transferred in a substantially linear manner to the diaphragm 325 through the diaphragm's neck area 326, which is attached to the former of the voice coil 315. Movement of the diaphragm 325 generates and radiates sound waves in response to the variations in the current driving the wire windings of the voice coil 315. Resonances of the diaphragm 325 are terminated or reflected at the neck area 326. Referring to the cross sectional view of FIG. 3 and the partial cross sections of FIGS. 4A and 4B, it can be seen that voice coil 315 includes a conventional tubular or cylindrical former having a bottom or proximal end opposite a top or distal end 316, and the former carries the conductive coil windings on the former's exterior sidewall, as is customary. The voice coil's tubular former has an interior lumen or open central region dimensioned to receive pole piece 320 and the pole piece's distally projecting extension structure 352. The voice coil's conductive windings are shown in partial section (as a thicker portion) suspended in the magnetic gap defined between the top plate 335 and the pole piece 320, which projects upwardly or distally from back plate 321, and the windings define a top or distal winding which is closest to the voice coil former's top or distal end 316. As can be seen from inspecting FIGS. 3 and 4A, the voice coil's windings do not cover the entire exterior sidewall of the voice coil former, and so an exposed distal portion of the voice coil's sidewall extends proximally from the voice coil former's top or distal end 316. In the embodiment illustrated in FIGS. 3, 4A and 4B, the neck area or inner peripheral edge of diaphragm 325 is affixed to voice coil 315 at the illustrated exposed distal portion of the voice coil's sidewall which extends proximally from the voice coil former's top or distal end 316. It can also be seen that the inner peripheral edge of annular suspension spider 340 is affixed to voice coil 315 at an exposed distal portion of the voice coil's sidewall proximally from the voice coil former's top or distal end 316. It is readily seen by inspecting FIGS. 3, 4A and $b that that the connection between the inner peripheral edge of annular suspension spider 340 is affixed to voice coil 315 at an exposed distal portion of the voice coil's sidewall which is also behind or proximal from the connection with the diaphragm's neck area or inner peripheral edge such that the connection with spider 340 is behind or below the connection with diaphragm 325. It can also be readily seen from the illustrations of FIGS. 3, 4A and 4B that diaphragm 325 is suspended on its outer peripheral edge by a convex half-roll elastomeric surround or outer roll seal 355 and is also suspended proximate its inner peripheral edge or neck area 326 by a second convex half-roll elastomeric surround or inner roll seal 360, where the cross sectional arch-shaped or semi-circular profile of outer roll seal 355 is substantially the same as the cross sectional arch-shaped or semi-circular profile of inner roll seal 360. It can also be seen from FIGS. 3, 4A and 4B that diaphragm 325 has a forward or distal surface which moves pistonically, where FIG. 4A illustrates an outward, distal or positive excursion, and FIG. 4B illustrates the inward, proximal or negative excursion, so that the piston area of transducer 300 comprises the exposed forward or distal surface of diaphragm 325.

In addition to the flared conical shape of the diaphragm 325 illustrated in FIG. 3, this component may assume various other shapes. In some embodiments, for example, the diaphragm 325 is an exponential flare or has a straight-sided conical shape. The diaphragm 325 may be made from various materials, as desired for specific performance characteristics and cost tradeoffs of the transducer 300. In some embodiments, for example, the diaphragm 325 is made from paper, composite materials, plastic, aluminum, and combinations of these and other materials. This list is not exclusive.

An annular spider 340 is attached at its outer periphery to a middle portion 346 of a frame 345. The inner periphery of the spider 340 is attached to the upper end of the voice coil 315, below the diaphragm 325. In this way, the spider 340 provides elastic support for the voice coil 315, aligning and centering the voice coil 315 on the pole piece 320 in both radial and axial directions. The spider 340 may be made from flexible material that can hold the voice coil 315 in place when the voice coil 315 is not driven by an electric current, and also allow the voice coil 315 to move up and down under influence of the electromotive force when the voice coil 315 is driven by an electric current. In some embodiments, the spider 340 is made from multi-layered fabric. Other suitable materials may also be used.

The frame 345, otherwise known as "chassis" or "basket," is used for attaching various components of the transducer 300, including the spider 340. The frame 345 also supports the transducer 300 for mounting in a baffle. It may be made from metal or another material with sufficient structural rigidity.

In the transducer 300, the frame 345 and front plate 335 are held together with bolts, while the front plate 335 and back plate 321 are attached to the magnet 330 with glue, e.g., epoxy. In some alternative embodiments, all these components are attached with glue or with one or more bolts. Other suitable attachment methods and combinations of methods may also be used for attaching these components to each other.

An outer roll seal 355 connects the outer periphery of the diaphragm 325 to upper lip 347 of the frame 345. The outer roll seal 355 is flexible to allow limited movement of the outer periphery of the diaphragm 325 relative to the frame 345. The dimensions of the outer seal 355 are such that it allows sufficient movement to accommodate the designed peak-to-peak excursion of the diaphragm 325 and the voice coil 315. In cross-section, the outer seal 355 may be arch-like, for example, semi-circular, as is shown in FIG. 3. It should be noted, however, that the invention is not necessarily limited to transducers with outer seals having arch-like cross-sections, but may include transducers with sinusoidal-like and other outer seal cross-sections. The material of the outer seal 355 may be chosen to terminate unwanted resonances in the diaphragm 325. The outer seal 355 may be made, for example, from flexible plastic, e.g., elastometric material, multi-layered fabric, impregnated fabric, or another material.

A waveguide extension structure 350 is attached to the upper end (as it appears in FIG. 3) of the pole piece 320 so as to fill a substantial portion of a cavity 380 defined by the volume swept by projecting the pole piece 320 upward (as the directions appear in FIG. 3) to intersect the plane defined by the outer periphery of the diaphragm 325 when the voice coil 315 is at rest. By filling the cavity 380, the waveguide extension structure 350 reduces distortions in the audio response of the transducer 300.

The shape of the waveguide extension structure 350 may be such that the structure 350 (1) clears the moving parts of the transducer 300, (2) minimizes (reduces) diffraction of sound energy, and (3) extends approximately to the plane defined by the outer periphery of the diaphragm 325 when the voice coil 315 is at rest. In the illustrated embodiment, the waveguide extension structure 350 includes a first portion 351 of a first diameter, and a second portion 352 of a second diameter. The second diameter is slightly larger than the first diameter, so that a ledge 353 is formed at the interface of the two portions. The second diameter may be larger than the diameter of the pole piece 320. Other shapes of the waveguide extension structure 350 also fall within the subject matter of the present invention. The waveguide extension structure 350 may be solid or hollow. The waveguide extension structure may be made integral with the pole piece 320, that is, made as part of the pole piece 320.

An inner flexible roll seal 360 provides a compliant connection between the diaphragm 325 and the waveguide extension structure 350, and prevents air leakage through the gap between the pole piece 320 and the voice coil 315. In other words, the inner seal 360 isolates the air in front of the diaphragm 325 from the air behind the diaphragm 325. To perform this function, the inner seal 360 may be made, for example, from non-porous material. In some embodiments, the inner seal 360 includes a rigid section where it attaches to the waveguide extension structure 350, ensuring solid attachment between these components. As shown in FIG. 3, the area of attachment of the inner seal 360 to the waveguide extension structure 350 is generally along the ledge 353.

Size, geometry, and material of the inner seal 360 may be selected for the inner seal 360 to satisfy one or more of several design criteria. First, these design selections may be made so that the inner seal 360 provides clearance for the moving parts of the transducer over the entire range of movement of the moving parts, i.e., so that the inner seal 360 allows the diaphragm 325 and the voice coil 315 to travel over the entire peak-to-peak excursion specified for the transducer 300. FIGS. 4A and 4B illustrate a portion of the cross-section of the transducer 300 in maximum positive and negative peak extension states, respectively, i.e., at the opposite ends of the design excursion. In FIG. 4A, note that top 316 of the voice coil 315 clears the inner seal 360.

Second, the inner seal 360 may be made to have only a minor impact on the compliance and moving mass of the transducer 300. For example, the inner seal 360 may decrease the efficiency of the transducer 300 by ten percent or less, as compared to a hypothetical transducer which is similar to the transducer 300 but with a dustcap replacing the inner seal 360, and increase the moving mass of the transducer 300 by ten percent or less.

Third, the inner seal 360 may be made to have only a minor impact on the piston area of the transducer 300. For example, the inner seal 360 may decrease the piston area by ten percent or less, as compared to an otherwise identical transducer but without the inner seal 360.

(When the combination of the inner seal 360 and the outer seal 355 (1) decreases the efficiency of the transducer 300 by ten percent or less as compared to the hypothetical transducer, (2) increases the moving mass of the transducer 300 by ten percent or less, and (3) decreases the piston area of the transducer 300 by ten percent or less, it can be said that the normal operational movement of the diaphragm 325 is substantially unchanged.)

Fourth, the inner seal 360 may be made from a material that interacts with the diaphragm 325 to terminate the unwanted resonances in the diaphragm 325.

In some embodiments, the inner seal 360 is a thin ring of elastometric material of substantially arch-like cross-section, for example, a semi-circular cross-section. This is illustrated in FIG. 3. As compared to a cross-section of a sinusoidal-like shape, an arch-like cross-section generally extends clearances, reduces moving mass, and increases piston area of the transducer. It should be noted, however, that the invention is not necessarily limited to transducers with inner seals having arch-like cross-sections, but may include transducers with sinusoidal-like, conical, and other inner seal cross-sections. In some embodiments, the dimensions (radius) of the arch-like cross section of the inner seal 360 are chosen to match the dimensions (radius) of the outer roll seal 355, so that the two roll seals have substantially the same working geometry and excursion capability. The inner seal 360 may be thickened at each end of the arch-like cross-section to help maintain the shape of the inner seal 360. Thickening of the ends also enhances the strength of the mechanical attachment of the inner seal 360 to the diaphragm 325 and to the waveguide extension structure 350 during operation of the transducer 300.

As has been described in the above paragraphs, the inner seal 360 may be made from flexible/compliant, non-porous materials. In particular, the inner seal 360 may exhibit substantially higher acoustic losses due to elastic damping at audio frequencies of interest than the acoustic losses of the material of diaphragm 325. The "frequencies of interest" in this context include frequencies within the range of the transducer 300. In selecting specific materials with acceptable elastic damping for the inner seal 360, a person skilled in the pertinent art could be guided by the same considerations as in selecting materials for a dustcap of a transducer having a dustcap and a diaphragm made from the same material as the diaphragm 325. In certain exemplary embodiments, the inner seal 360 is made from synthetic rubber, synthetic rubber with added plasticizer (to increase elastic damping), polypropelene, impregnated cloth, butelene, and silicone rubber. The above list is not exclusive.

In some embodiments, the inner seal 360 is attached to the diaphragm 325 in the neck area of the diaphragm 325, i.e., the area proximate to the periphery of its central opening. For example, the "neck area" may include ten percent of the total area of the diaphragm 325 that is nearest the central opening.

This document describes the inventive acoustic transducers in considerable detail. This was done for illustration purposes only. Neither the specific embodiments of the invention as a whole, nor those of its features limit the general principles underlying the invention. The specific features described herein may be used in some embodiments, but not in others, without departure from the spirit and scope of the invention as set forth. Various materials for transducer components also fall within the intended scope of the invention. Many additional modifications are intended in the foregoing disclosure, and it will be appreciated by those of ordinary skill in the art that in some instances some features of the invention will be employed in the absence of a corresponding use of other features. The illustrative examples therefore do not define the metes and bounds of the invention and the legal protection afforded the invention, which function is carried out by the claims and their equivalents.

We claim:

1. An acoustic transducer, comprising:

a pole piece comprising a first end;

a voice coil comprising wire windings configured to receive electrical current, the voice coil being configured to move along the first end of the pole piece;

a magnetic structure comprising parts defining an air gap, wherein the voice coil on the first end of the pole piece is disposed in the air gap so that the magnetic structure creates a magnetic field in which the voice coil is configured to move along the first end of the pole piece;

a diaphragm comprising an inner periphery defining a central opening and an outer periphery, the inner periphery of the diaphragm being attached to the voice coil to move with the voice coil; wherein said diaphragm is configured to move as a piston;

a waveguide extension structure attached to the first end of the pole piece; and an inner flexible roll seal coupled to the diaphragm and to the waveguide extension structure, wherein the inner flexible roll seal seals a gap between the voice coil and the first end of the pole piece.

2. An acoustic transducer according to claim 1, wherein the inner flexible roll seal includes non-porous material.

3. An acoustic transducer according to claim 2, wherein the inner flexible roll seal comprises an elastic damping material that dampens sound waves within frequency range of the acoustic transducer to a substantially greater degree than degree of damping of the sound waves by the diaphragm.

4. An acoustic transducer according to claim 2, wherein the inner flexible roll seal is substantially arch-shaped in cross-section.

5. An acoustic transducer according to claim 2, wherein the inner flexible roll seal is substantially semicircular in cross-section.

6. An acoustic transducer according to claim 2, wherein decrease in effective piston area of the transducer caused by the inner flexible roll seal and the waveguide extension structure is less than about ten percent as compared to a transducer with identical components but without the inner flexible roll seal and without the waveguide extension structure.

7. An acoustic transducer according to claim 2, wherein decrease in efficiency of the transducer caused by the inner flexible roll seal and the waveguide extension structure is less than about ten percent as compared to a transducer with identical components but without the inner flexible roll seal and without the waveguide extension structure.

8. An acoustic transducer according to claim 2, wherein increase in moving mass of the transducer caused by the inner flexible roll seal and the waveguide extension structure is less than about ten percent as compared to a transducer with identical components but without the inner flexible roll seal and without the waveguide extension structure.

9. An acoustic transducer according to claim 1, wherein the inner flexible roll seal comprises a ring of elastometric non-porous material.

10. An acoustic transducer according to claim 9, wherein the inner flexible roll seal is substantially arch-shaped in cross-section.

11. An acoustic transducer according to claim 10, wherein decrease in piston area of the transducer caused by the inner flexible roll seal and the waveguide extension structure is less than about ten percent as compared to a transducer with identical components but without the inner flexible roll seal and without the waveguide extension structure.

12. An acoustic transducer according to claim 10, wherein decrease in efficiency of the transducer caused by the inner flexible roll seal and the waveguide extension structure is less than about ten percent as compared to a transducer with identical components but without the inner flexible roll seal and without the waveguide extension structure.

13. An acoustic transducer according to claim 9, further comprising: a frame attached to the magnetic structure; and an outer roll seal attaching the outer periphery of the diaphragm to the frame; wherein: the magnetic structure comprises a permanent magnet and a front plate comprising portions defining an annular opening; and the voice coil and the first end of the pole piece are disposed in the opening of the front plate.

14. An acoustic transducer according to claim 13, further comprising a spider attached to the frame and to the voice coil, wherein the spider aligns and centers the voice coil.

15. An acoustic transducer according to claim 13, wherein the outer roll seal is made from substantially the same material as the inner flexible roll seal.

16. An acoustic transducer according to claim 15, wherein the outer roll seal has substantially the same working geometry and excursion capability as the inner flexible roll seal.

17. An acoustic transducer according to claim 13, wherein the waveguide extension structure extends substantially to a plane defined by the outer periphery of the diaphragm when the voice coil is at rest.

18. An acoustic transducer according to claim 13, wherein the waveguide extension structure extends not substantially farther than a plane defined by the outer periphery of the diaphragm when the voice coil is at maximum forward excursion.

19. An acoustic transducer according to claim 1, wherein the waveguide extension structure occupies more than one half of a cavity formed by projecting the first end of the pole piece to a plane defined by the outer periphery of the diaphragm.

20. An acoustic transducer according to claim 1, wherein the inner flexible roll seal comprises synthetic rubber.

21. An acoustic transducer according to claim 1, wherein the inner flexible roll seal comprises synthetic rubber and plasticizer.

22. An acoustic transducer, comprising:

a cylindrical pole piece comprising a first end; a voice coil comprising wire windings for receiving electrical current, the voice coil being configured to move along the first end of the cylindrical pole piece;

a magnetic structure means for immersing the voice coil in magnetic flux interacting with the electrical current in the wire windings to apply a force to the voice coil to cause the voice coil to move along the cylindrical pole piece;

a diaphragm comprising an inner periphery defining a central opening and an outer periphery, the inner periphery of the diaphragm being attached to the voice coil to move with the voice coil; wherein said diaphragm is configured to move as a piston;

a waveguide means for reducing high frequency distortions of the acoustic transducer, the waveguide means being attached to the first end of the pole piece;

a frame for mounting the diaphragm, and the magnetic structure; and a flexible inner seal means for isolating air mass in front of the diaphragm from air mass behind the diaphragm.

23. An acoustic transducer according to claim 22, wherein the flexible inner seal means comprises means for damping acoustic vibrations of the diaphragm.

24. An electro-acoustic transducer comprising:

a frame;

a pole;

a diaphragm comprising an outer periphery, an inner periphery defining an opening in the diaphragm, and a neck area proximate the inner periphery; wherein said diaphragm is configured to move as a piston;

an outer flexible roll seal connecting the outer periphery of the diaphragm to the frame;

a waveguide extension of the pole that substantially fills cavity in front of the pole;

a voice coil moveable along the pole and connected to the neck area of said diaphragm;

and an inner flexible roll seal connecting said waveguide extension of the pole to the neck area of said diaphragm, wherein the inner flexible roll seal and the outer flexible roll seal are configured such that there is substantially no air leakage between the diaphragm and the waveguide extension of the pole, such that the normal operational movement of the diaphragm is substantially unchanged, and such that resonances in the diaphragm are terminated by the combination of the inner and outer flexible roll seals.

25. The electro-acoustic transducer of claim 24, wherein the diaphragm is shaped substantially as a straight-sided cone.

26. The electro-acoustic transducer of claim 24, wherein the diaphragm is shaped substantially as an exponentially curved flare.

27. The electro-acoustic transducer of claim 24, wherein the waveguide extension of the pole is integral with the pole.

28. The electro-acoustic transducer of claim 24, wherein the waveguide extension of the pole comprises a portion that reduces in diameter in a smooth arc.

29. The electro-acoustic transducer of claim 24, wherein the waveguide extension of the pole expands in front of the inner roll seal to a diameter greater than diameter of the pole at a junction of the pole and the waveguide extension of the pole.

30. The electro-acoustic transducer of claim 24, wherein the waveguide extension of the pole ascends to a height substantially no less than height of the diaphragm with the voice coil at rest, and substantially no more than height of the diaphragm at maximum excursion.

31. The electro-acoustic transducer of claim 24, wherein the inner flexible roll seal is substantially semi-circular in cross-section.

32. The electro-acoustic transducer of claim 24, wherein the inner flexible roll seal has substantially the same geometry and excursion capability as the outer flexible roll seal.

33. The electro-acoustic transducer of claim 24, wherein the inner and outer flexible roll seals function to extend the diaphragm from the frame to the waveguide extension of the pole, thereby effectively separating and sealing the air at the front of the diaphragm from the air at the back of the diaphragm.

34. The electro-acoustic transducer of claim 24, wherein the inner flexible roll seal has a thickened inner foot ring providing rigidity in area of attachment of the inner flexible roll seal to the waveguide extension of the pole.

* * * * *